US011725853B2

(12) United States Patent
Cheng et al.

(10) Patent No.: US 11,725,853 B2
(45) Date of Patent: Aug. 15, 2023

(54) STIRLING COOLER STRUCTURE HAVING MULTIPLE COOLING MODULES

(71) Applicant: NATIONAL CHENG KUNG UNIVERSITY, Tainan (TW)

(72) Inventors: Ching-Hsiang Cheng, Tainan (TW); Shang-Ting Huang, Taichung (TW)

(73) Assignee: National Cheng Kung University, Tainan (TW)

( * ) Notice: Subject to any disclaimer, the term of this patent is extended or adjusted under 35 U.S.C. 154(b) by 119 days.

(21) Appl. No.: 17/394,739

(22) Filed: Aug. 5, 2021

(65) Prior Publication Data

US 2023/0043596 A1 Feb. 9, 2023

(51) Int. Cl.
*F25B 9/10* (2006.01)
*F25B 9/14* (2006.01)

(52) U.S. Cl.
CPC ..... *F25B 9/14* (2013.01); *F25B 9/10* (2013.01); *F25B 2309/1428* (2013.01)

(58) Field of Classification Search
CPC ..... F25B 9/14; F25B 9/10; F25B 2309/1428
USPC ..... 62/6
See application file for complete search history.

(56) References Cited

U.S. PATENT DOCUMENTS

2002/0134088 A1* 9/2002 Rudick ..... F28D 15/0266 62/448

FOREIGN PATENT DOCUMENTS

TW I539125 B * 11/2014 ..... F25B 27/00

OTHER PUBLICATIONS

Hsieng, Stirling heating and cooling apparatus, 2014, Full Document (Year: 2014).*

* cited by examiner

*Primary Examiner* — Nael N Babaa
(74) *Attorney, Agent, or Firm* — Rosenberg, Klein & Lee

(57) ABSTRACT

A Stirling cooler structure having multiple cooling modules includes at least one power unit, a pipeline, a plurality of Stirling cooling modules, and at least one piezoresistive unit. The power unit includes a cylinder and a piston. The pipeline is connected to the cylinder. The Stirling cooling modules each include a pipe and a passive displacer. The passive displacer is reciprocally, movably disposed in the pipe to partition the pipe into a cold end and a hot end. The hot end is connected to the pipeline. The piston is driven by an electric motor for a compressed air to flow through the pipeline to the hot end and then flow to the cold end through the passive displacer, such that the cold end absorbs ambient heat. The piezoresistive unit is selectively disposed between the Stirling cooling modules and the cylinder.

6 Claims, 9 Drawing Sheets

STIRLING COOLER STRUCTURE HAVING MULTIPLE COOLING MODULES

FIELD OF THE INVENTION

The present invention relates to a Stirling cooler structure, and more particularly to a Stirling cooler structure having multiple cooling modules. A piezoresistive unit is provided to control a phase difference of movement strokes of passive displacers of multiple Stirling cooling modules, so as to control the cooling effect of the Stirling cooling modules.

BACKGROUND OF THE INVENTION

Taiwan Patent No. 1539125 discloses a Stirling heating and cooling apparatus, comprising a Stirling engine and at least one cooling module. The Stirling engine includes a cylinder and a piston mounted in the cylinder, and is divided into a first working space and a second working space by a first porous material. The cooling module is divided into a third working space and a fourth working space by a second porous material. The piston separates the second working space from the third working space, which prevents a first working gas used in the Stirling engine from interfering or mixing with a second working gas used in the cooling module and optimizes the performance of the apparatus. FIG. 1 of this patent shows the structure of a cooling module driven by a Stirling engine. The cooling end of the cooling module is configured to absorb the ambient heat, thereby reducing the temperature of the environment and achieving a cooling effect. FIG. 11 of this patent shows the structure of multiple cooling modules driven by a Stirling engine. With the multiple cooling modules, the rate of heat transfer is improved.

However, the above-mentioned prior art still has the following defects.

1. Referring to FIG. 9, multiple cooling modules A use a Stirling engine as the power source. The distance between each cooling module A and the Stirling engine is different. As a result, the displacer A1 of each cooling module A has a stroke difference S1, S2, S3 (phase difference) during the movement, and the farther the distance between the cooling module A and the Stirling engine, the greater the phase difference. This will result in that the farther cooling module has a poorer cooling effect. Besides, since the pressure drop cannot be controlled, the coldness of the cooling module A cannot be controlled.

2. The multiple cooling modules are arranged in a straight line. There is no pressure drop control between the Stirling engine and the pipeline of the multiple cooling modules, so the phase difference cannot be controlled.

3. Only one Stirling engine is used as the power source. Limited by the performance of the Stirling engine and the heating temperature, the number of revolutions of the compression part of the Stirling engine cannot be adjusted arbitrarily. Therefore, the temperature of the heat exhaust part of the cooling module cannot be controlled, and the cooling rate is limited. It takes a long time to be cooled to the working temperature when an extremely low temperature environment is required, so it is not suitable for those who need rapid cooling.

4. With the Stirling engine as the power source, the Stirling engine must be driven by a high-temperature heat source for driving multiple cooling modules. If there is no high-temperature heat source, it cannot be operated. Therefore, the conditions are limited, and the cooling modules need to be close to the high-temperature heat source, which affects the temperature in the cooling modules.

SUMMARY OF THE INVENTION

According to one aspect of the present invention, a Stirling cooler structure having multiple cooling modules is provided. The Stirling cooler structure comprises at least one power unit, a pipeline, and a plurality of Stirling cooling modules. The power unit includes a cylinder and a piston. The pipeline is connected to the cylinder. The Stirling cooling modules each include a pipe and a passive displacer. The passive displacer is reciprocally, movably disposed in the pipe to partition the pipe into a cold end and a hot end. The hot end is connected to the pipeline. At least one piezoresistive unit is provided on the pipeline. The piezoresistive unit is selectively disposed between the Stirling cooling modules and the cylinder.

The piston is driven to compress air in the cylinder to form a compressed air. The compressed air flows through the pipeline to the hot end and then flows to the cold end through the passive displacer. The cold end absorbs ambient heat so that the compressed air is expanded to flow back to the cylinder through the passive displacer. When the compressed air passes through the piezoresistive unit, a pressure of the compressed air is changed, thereby changing a movement stroke of the passive displacer and a phase difference between the movement strokes of the passive displacers of the Stirling cooling modules. Therefore, by adjusting the pressure drop of the compressed air passing through the piezoresistive unit, the coldness of the cold ends of the respective Stirling cooling modules can be controlled.

Preferably, the piezoresistive unit is one of a valve and a porous member. Preferably, the valve is one of a constant temperature expansion valve, a constant pressure expansion valve and a constant flow expansion valve.

Preferably, the power unit further includes an electric motor, and the electric motor is connected to the piston.

Preferably, the cold ends of the Stirling cooling modules are arranged in a single straight line, multiple straight lines, a radial form, a single circle, multiple circles, or a combination thereof.

Preferably, the cold ends of the Stirling cooling modules are different in size.

According to another aspect of the present invention, a Stirling cooler structure having multiple cooling modules is provided. The Stirling cooler structure comprises at least one power unit, a pipeline, and a plurality of Stirling cooling modules. The power unit includes a cylinder and a piston. The pipeline is connected to the cylinder. The Stirling cooling modules each include a pipe and a passive displacer. The passive displacer is reciprocally, movably disposed in the pipe to partition the pipe into a cold end and a hot end. The hot end is connected to the pipeline. The pipeline has at least one diameter-changing portion. The diameter-changing portion is selectively disposed between the Stirling cooling modules and the cylinder.

The piston is driven to compress air in the cylinder to form a compressed air. The compressed air flows through the pipeline to the hot end and then flows to the cold end through the passive displacer. The cold end absorbs the ambient heat so that the compressed air is expanded to flow back to the cylinder through the passive displacer. When the compressed air passes through the diameter-changing portion, a pressure of the compressed air is changed, thereby changing a movement stroke of the passive displacer and a phase difference between the movement strokes of the passive displacers of the Stirling cooling modules. Therefore, by controlling the diameter of the diameter-changing portion, the pressure drop of the compressed air passing through the diameter-changing portion can be controlled, and the coldness of the cold ends of the respective Stirling cooling modules can be controlled.

Through the above technical features, the following effects can be achieved:

1. The pipeline between the power unit and the multiple Stirling cooling modules is provided with the piezoresistive unit or the diameter-changing portion. By adjusting the fluid pressure of each Stirling cooling module through the corresponding piezoresistive unit or diameter-changing portion, the passive displacer of each Stirling cooling module has a controllable movement stroke, so that each Stirling cooling module has a controllable cooling effect. For example, the passive displacer of each Stirling cooling module can be controlled to have the same movement stroke, so that each Stirling cooling module has a consistent cooling effect.

2. The power unit uses the electric motor to drive the piston, which can freely adjust the number of revolutions of the compression part and control the cooling temperature of the cold end of the Stirling cooling module.

3. The power unit uses the electric motor to drive the piston, thereby overcoming the shortcoming of requiring a high-temperature heat source for operation.

4. The Stirling cooling modules may be arranged in a single straight line, multiple straight lines, a radial form, a single circle, multiple circles, or a combination thereof. The power unit may be arranged in the center of the multiple Stirling cooling modules. The power unit may be plural. Multiple power units can increase the cooling capacity, thereby meeting the required temperature quickly.

5. The Stirling cooling module includes a cold end and a hot end. The cold end is configured to cool the surrounding environment, and the hot end is configured to heat the surrounding environment.

DESCRIPTION OF THE PREFERRED EMBODIMENTS

Embodiments of the present invention will now be described, by way of example only, with reference to the accompanying drawings.

Figure 1:
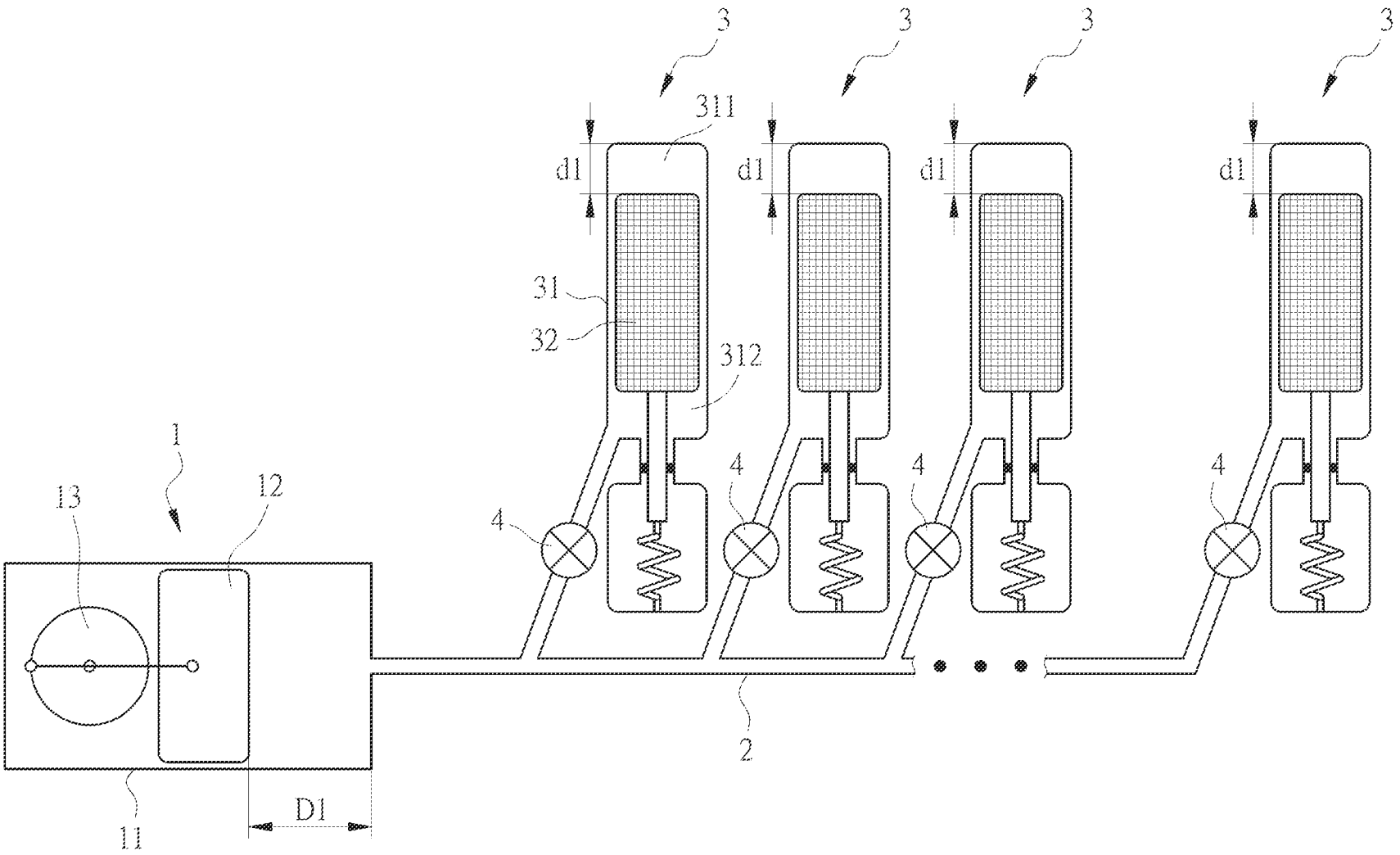
FIG. 1 is a schematic view of the Stirling cooler structure according to a first embodiment of the present invention, wherein the piezoresistive unit is disposed between each Stirling cooling module and the cylinder.

As shown in FIG. 1, the present invention discloses a Stirling cooler structure having multiple cooling modules. The Stirling cooler structure according to a first embodiment of the present invention comprises at least one power unit 1, a pipeline 2, a plurality of Stirling cooling modules 3, and at least one piezoresistive unit 4.

The power unit 1 includes a cylinder 11 and a piston 12. The piston 12 is mounted in the cylinder 11 and has a distance D1 from the bottom dead center of the cylinder 11. In this embodiment, the power unit 1 further includes an electric motor 13. The electric motor 13 is connected to the piston 12 for driving the piston 12 to move in the cylinder 11. The pipeline 2 is connected to the cylinder 11. Each Stirling cooling module 3 includes a pipe 31 and a passive displacer 32. The passive displacer 32 is reciprocally, movably disposed in the pipe 31 to partition the pipe 31 into a cold end 311 and a hot end 312. The hot end 312 is connected to the pipeline 2. The passive displacer 32 is at a distance d1 from the bottom dead center of the cold end 311. The piezoresistive unit 4 is disposed on the pipeline 2, and is selectively disposed between the Stirling cooling modules 3 and the cylinder 11. In this embodiment, the piezoresistive unit 4 is provided between each of the Stirling cooling modules 3 and the cylinder 11. The piezoresistive unit 4 may use, for example, a valve or a porous member. The valve may use, for example, a constant temperature expansion valve, a constant pressure expansion valve or a constant flow expansion valve.

Figure 2:
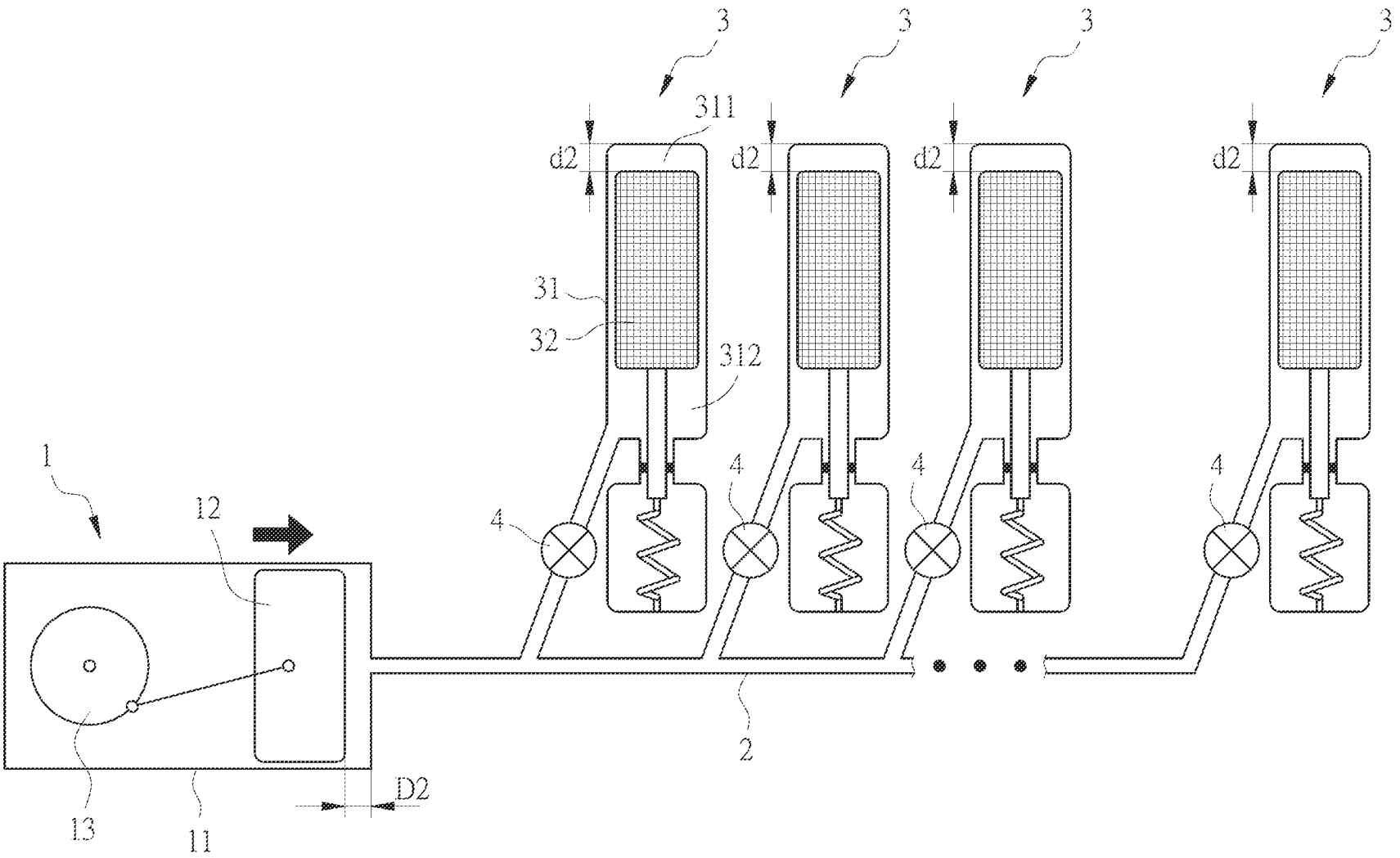
FIG. 2 is a schematic view of the implementation state of the Stirling cooler structure according to the first embodiment of the present invention.

Referring to FIG. 1 and FIG. 2, when the electric motor 13 is started, the electric motor 13 drives the piston 12 to compress the air in the cylinder 11 to heat up to form a compressed air. The compressed air flows through the pipeline 2 to the hot end 312 of the pipe 31 of the Stirling cooling module 3, and then flows to the cold end 311 through the passive displacer 32 to cool down. The cold end 311 is configured to absorb the ambient heat to have a cooling effect. In contrast, the hot end 312 is configured to heat the surrounding environment and has the effect of a heater. The compressed air absorbs the heat at the cold end 311 to increase the temperature, and is expanded to flow back to the cylinder 11 through the passive displacer 32 to form a complete thermodynamic cycle. The power unit 1 uses the electric motor 13 to drive the piston 12, which overcomes the disadvantage that the prior art requires a high-temperature heat source for the Stirling engine to drive the piston.

It should be particularly noted that when the compressed air enters the pipe 31 of each Stirling cooling module 3, the pressure drop can be adjusted through the piezoresistive unit 4 between each Stirling cooling module 3 and the cylinder 11. When the compressed air enters the hot end 312 of the pipe 31 of each Stirling cooling module 3, it has the same pressure, so that the passive displacer 32 of each Stirling cooling module 3 has a movement stroke that tends to be uniform. For example, when the piston 12 is moved to have a distance D2 from the bottom dead center of the cylinder 11, the passive displacer 32 of each Stirling cooling module 3 is moved to have a distance d2 from the bottom dead center of the opposite cold end 311, thereby changing the phase difference between the movement strokes of the passive displacers 32 of the Stirling cooling modules 3. Thus, the cold end 311 of the pipe 31 of each Stirling cooling module 3 has a cooling effect that tends to be uniform. Alternatively, according to different cooling requirements, different pressure drops are adjusted through the piezoresistive unit 4, so that the cold end 311 of the pipe 31 of each Stirling cooling module 3 has a different cooling effect. That is, in this embodiment, the passive displacer 32 of each Stirling cooling module 3 has a controllable movement stroke, so that the cold end 311 of each Stirling cooling module 3 has a controllable cooling effect. The power unit 1 uses the electric motor 13 to drive the piston 12, so the number of revolutions of the compression part of the cylinder 11 can be adjusted freely. Thus, the temperature of the hot end 312 of the subsequent Stirling cooling module 3 can be controlled to control the cooling capacity of the Stirling cooling module 3.

Figure 3:
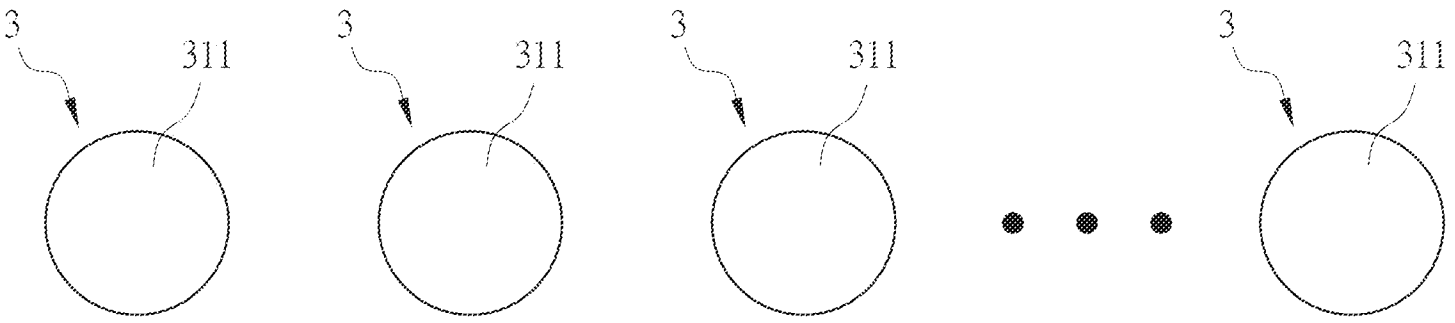
FIG. 3 is a schematic view of the Stirling cooler structure according to the first embodiment of the present invention, wherein the Stirling cooling modules are arranged in a straight line.
Figure 4:
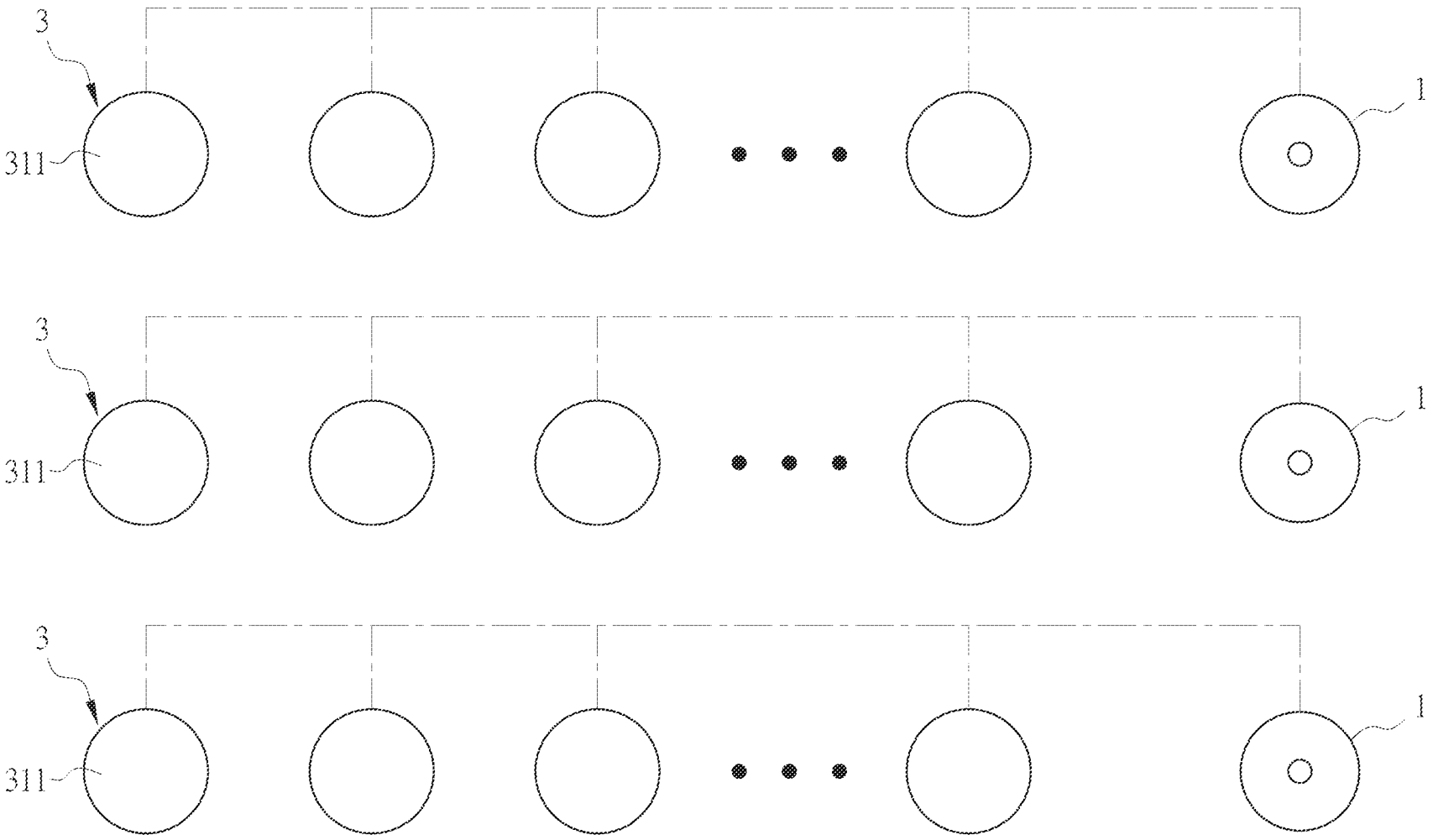
FIG. 4 is a schematic view of the Stirling cooler structure according to the first embodiment of the present invention, wherein the Stirling cooling modules are arranged in multiple straight lines.
Figure 5:
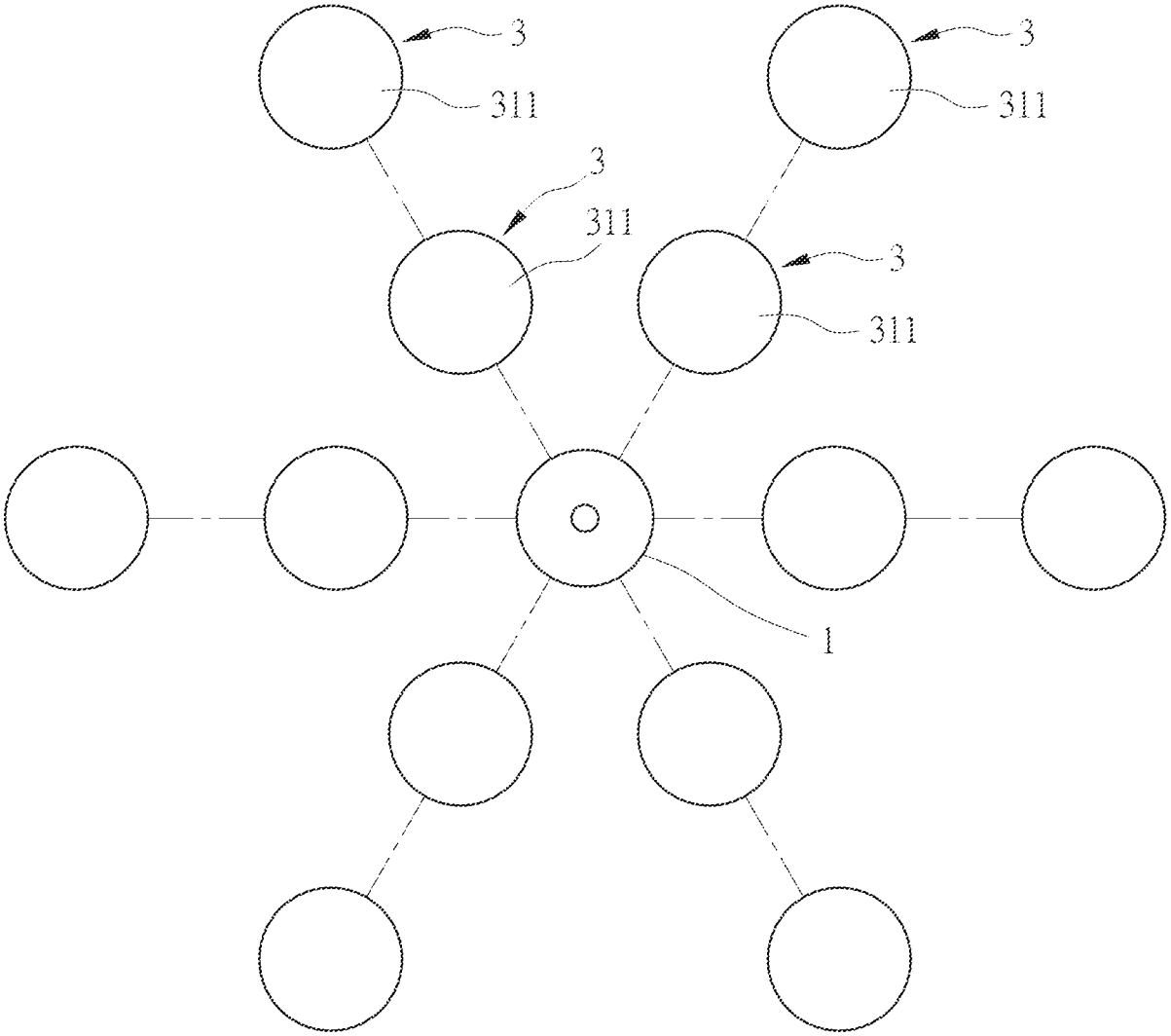
FIG. 5 is a schematic view of the Stirling cooler structure according to the first embodiment of the present invention, wherein the Stirling cooling modules are arranged radially.
Figure 6:
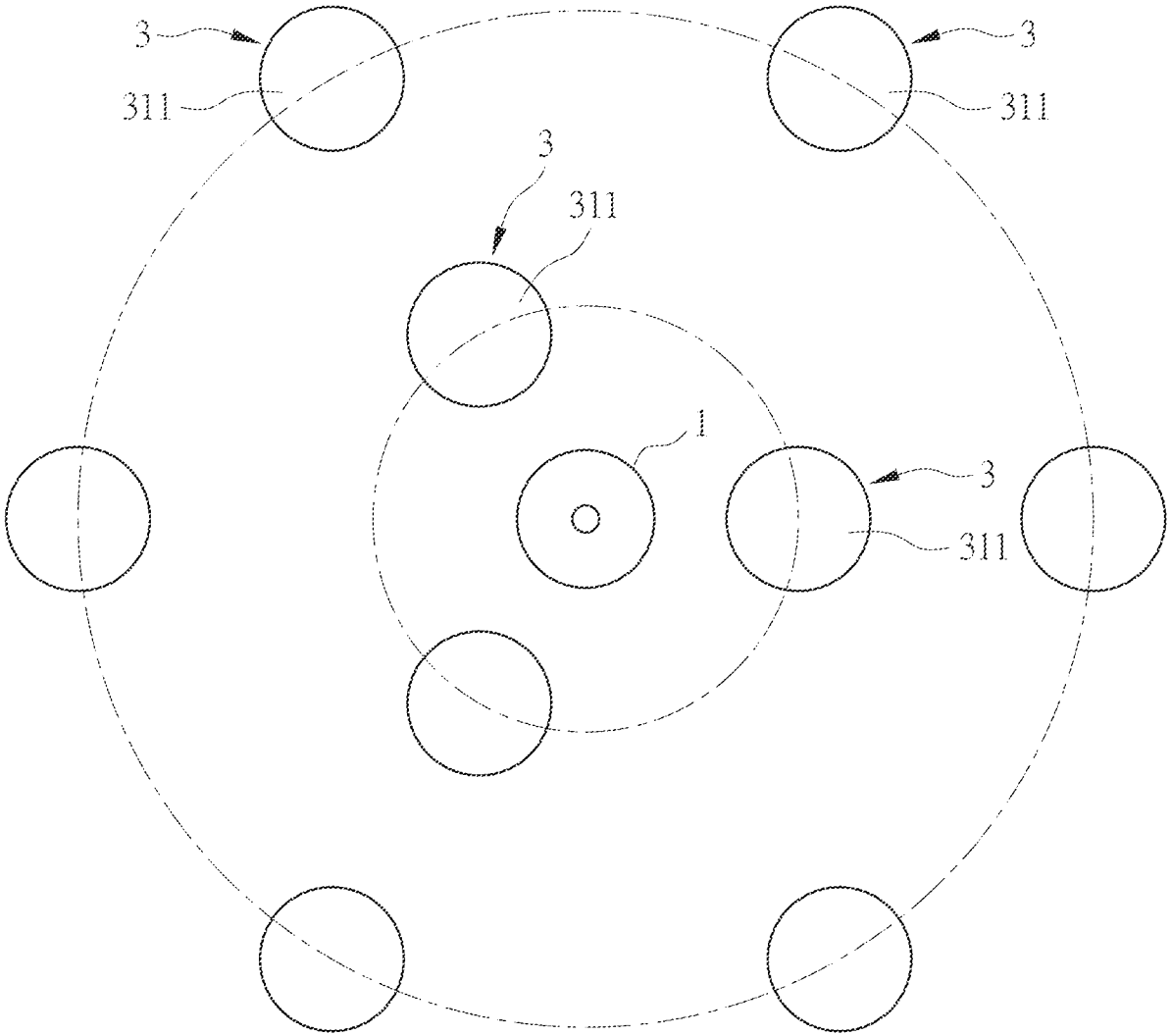
FIG. 6 is a schematic view of the Stirling cooler structure according to the first embodiment of the present invention, wherein the Stirling cooling modules are arranged in multiple circles.

Referring to FIGS. 3 to 6, according to different cooling requirements (such as the size, compartment and shape of the cooling space), the cold ends 311 of the Stirling cooling modules 3 may be arranged in different ways. For example, they are arranged in a single straight line as shown in FIG. 3 or arranged in multiple straight lines as shown in FIG. 4. They may be arranged radially as shown in FIG. 5, or arranged in multiple circles as shown in FIG. 6 (or arranged in a single circle), or they are arranged arbitrarily. As shown in FIG. 4, the power unit 1 may be plural according to the needs, or as shown in FIG. 5 and FIG. 6, the power unit 1 may be arranged in the center of the multiple Stirling cooling modules 3.

Figure 7:
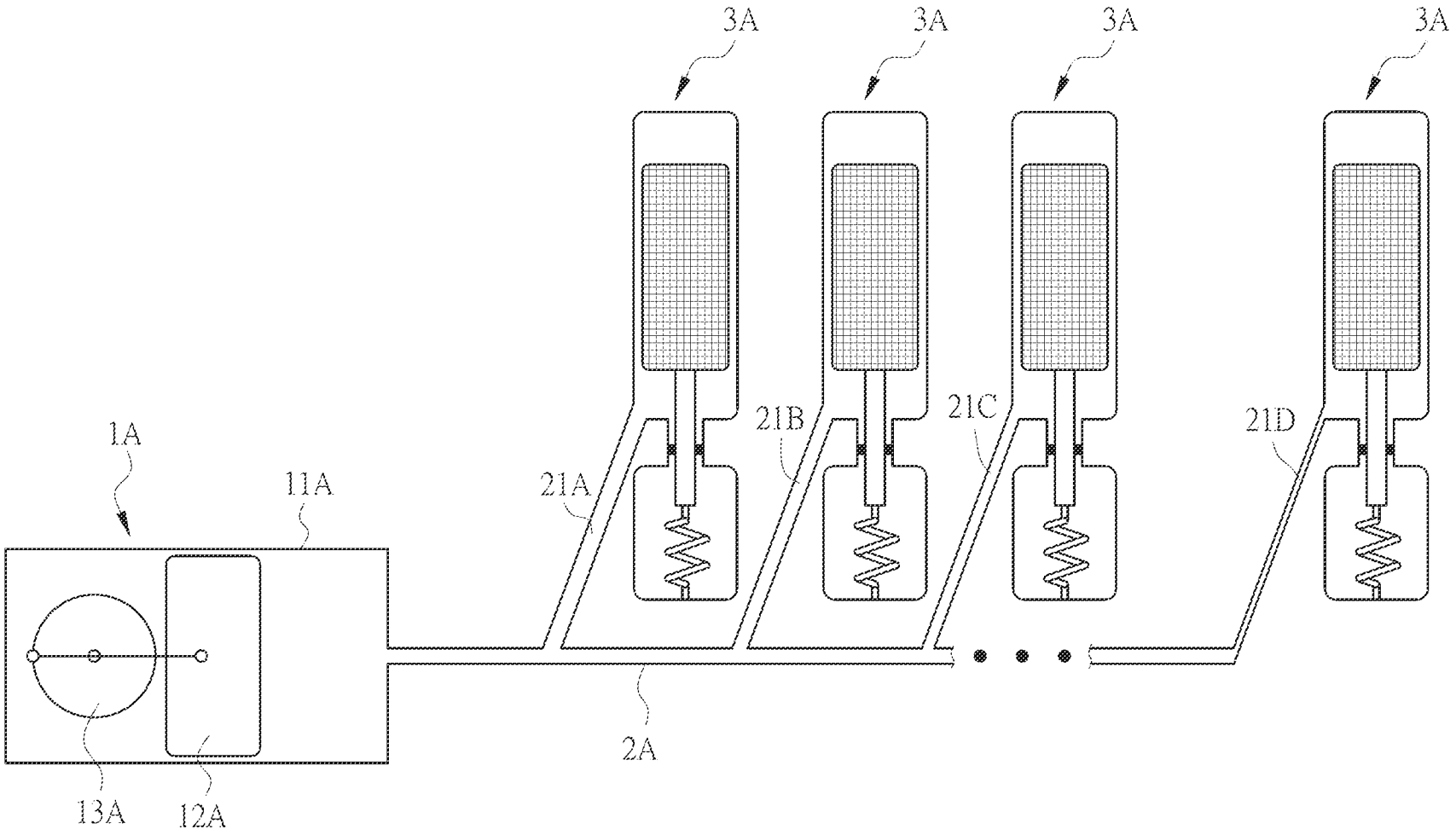
FIG. 7 is a schematic view of the Stirling cooler structure according to a second embodiment of the present invention, wherein the diameter-changing portion of the pipeline is disposed between each Stirling cooling module and the cylinder.

FIG. 7 illustrates a second embodiment of the present invention. In this embodiment, the Stirling cooler structure comprises at least one power unit 1A, a pipeline 2A, and a plurality of Stirling cooling modules 3A.

The power unit 1A includes a cylinder 11A and a piston 12A. The piston 12A is mounted in the cylinder 11A. In this embodiment, the power unit 1A further includes an electric motor 13A. The electric motor 13A is connected to the piston 12A. The pipeline 2A is connected to the cylinder 11A. The Stirling cooling modules 3 are connected to the pipeline 2. The second embodiment is substantially similar to the first embodiment with the exceptions described hereinafter. The piezoresistive unit 4 is not provided in the second embodiment. The pipeline 2A has diameter-changing portions 21A, 21B. 21C, 21D connected to the respective Stirling cooling modules 3A. In this embodiment, the pressure of the compressed air entering each Stirling cooling module 3A is controlled according to the diameter-changing portions 21A, 21B, 21C, 21D, so as to control the cooling effect of each Stirling cooling module 3A.

Figure 8:
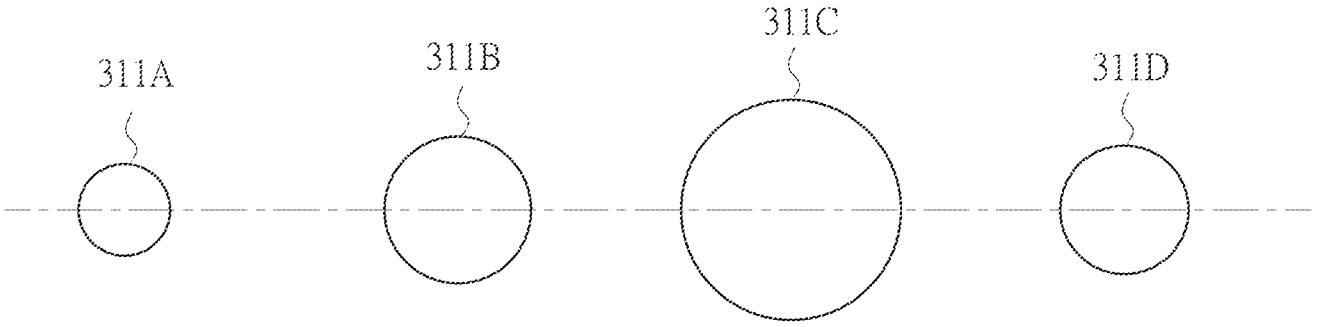
FIG. 8 is a schematic view of the Stirling cooler structure according to a third embodiment of the present invention, wherein the cold ends of the Stirling cooling modules are different in size.
Figure 9:
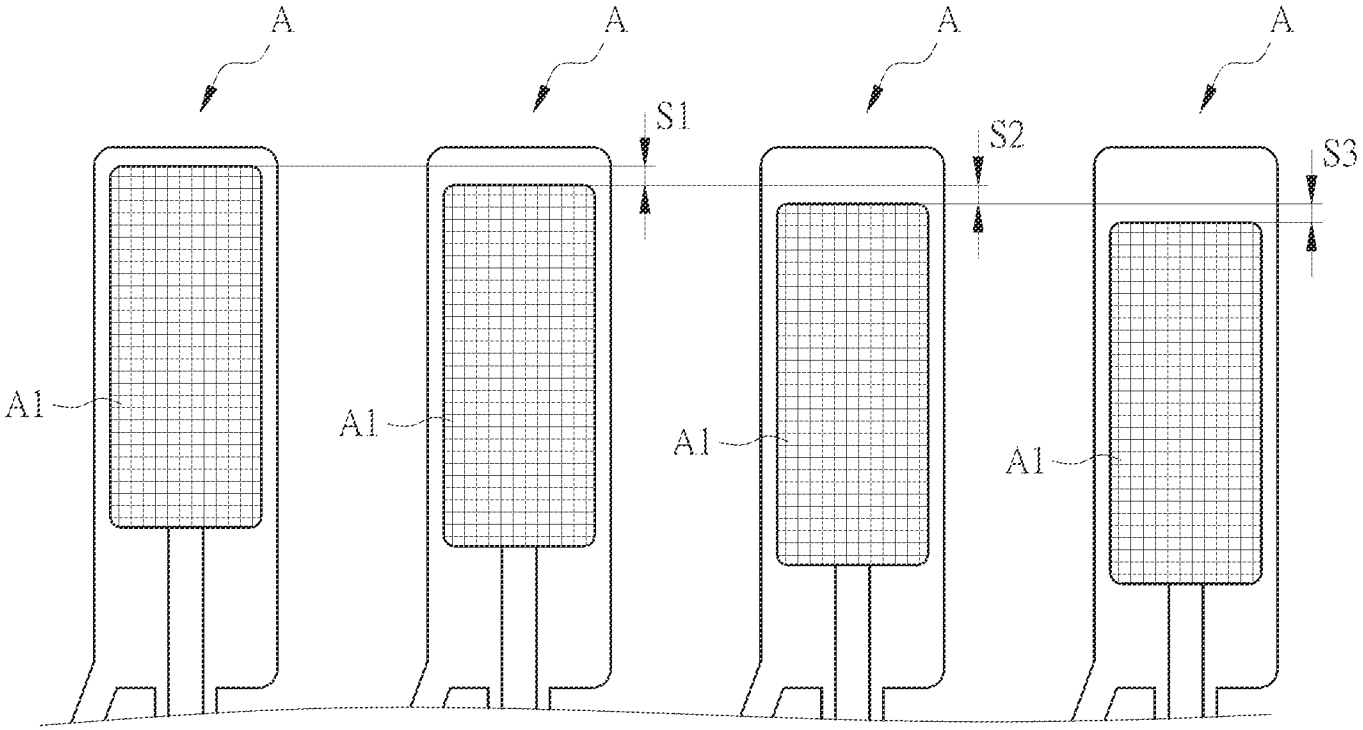
FIG. 9 (PRIOR ART)
FIG. 9 is a schematic view showing the phase difference of the displacers of the cooling modules when the conventional Stirling heating and cooling apparats is in use, wherein the phase difference cannot be controlled.

FIG. 8 illustrates a third embodiment of the present invention. In the Stirling cooler structure of this embodiment, the sizes of the cold ends 311A, 311B, 311C, 311D of the Stirling cooling modules are different. Therefore, the cold ends 311A, 311B, 311C, 311D in different sizes can be selected according to the size of the cooling space. For example, when the cooling space is large, the large-sized cold end 311C can be selected; when the cooling space is small, the small-sized cold end 311A can be selected.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A Stirling cooler structure, comprising:

at least one power unit, including a cylinder and a piston;

a pipeline, connected to the cylinder;

a plurality of Stirling cooling modules, each including a pipe and a passive displacer, the passive displacer being reciprocally, movably disposed in the pipe to partition the pipe into a cold end and a hot end, wherein the hot end is connected to the pipeline;

wherein the piston is driven to compress air in the cylinder to form a compressed air, the compressed air flows through the pipeline to the hot end and then flows to the cold end through the passive displacer, the cold end absorbs ambient heat so that the compressed air is expanded to flow back to the cylinder through the passive displacer, characterize in that: the pipeline is provided with at least one piezoresistive unit, the piezoresistive unit is selectively disposed between the Stirling cooling modules and the cylinder, when the compressed air passes through the piezoresistive unit, a pressure of the compressed air is changed, thereby changing a movement stroke of the passive displacer and a phase difference between the movement strokes of the passive displacers of the Stirling cooling modules.

2. The Stirling cooler structure as claimed in claim 1, wherein the piezoresistive unit is one of a valve and a porous member.

3. The Stirling cooler structure as claimed in claim 2, wherein the valve is one of a constant temperature expansion valve, a constant pressure expansion valve and a constant flow expansion valve.

4. The Stirling cooler structure as claimed in claim 1, wherein the power unit further includes an electric motor, and the electric motor is connected to the piston.

5. The Stirling cooler structure as claimed in claim 1, wherein the cold ends of the Stirling cooling modules are arranged in a single straight line, multiple straight lines, a radial form, a single circle, multiple circles, or a combination thereof.

6. The Stirling cooler structure as claimed in claim 1, wherein the cold ends of the Stirling cooling modules are different in size.

* * * * *